US011545292B2

(12) United States Patent
Inaba et al.

(10) Patent No.: US 11,545,292 B2
(45) Date of Patent: Jan. 3, 2023

(54) REACTOR

(71) Applicants: AutoNetworks Technologies, Ltd., Yokkaichi (JP); Sumitomo Wiring Systems, Ltd., Yokkaichi (JP); Sumitomo Electric Industries, Ltd., Osaka (JP)

(72) Inventors: Kazuhiro Inaba, Yokkaichi (JP); Takemi Terao, Osaka (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 507 days.

(21) Appl. No.: 16/615,489

(22) PCT Filed: May 1, 2018

(86) PCT No.: PCT/JP2018/017456
§ 371 (c)(1),
(2) Date: Nov. 21, 2019

(87) PCT Pub. No.: WO2018/216441
PCT Pub. Date: Nov. 29, 2018

(65) Prior Publication Data

US 2020/0118728 A1 Apr. 16, 2020

(30) Foreign Application Priority Data

May 22, 2017 (JP) ..... JP2017-100955

(51) Int. Cl.
*H01F 27/26* (2006.01)
*H01F 27/24* (2006.01)
(Continued)

(52) U.S. Cl.
CPC ..... *H01F 27/24* (2013.01); *H01F 27/306* (2013.01); *H01F 37/00* (2013.01)

(58) Field of Classification Search
CPC ..... H01F 27/24; H01F 27/306; H01F 37/00; H01F 27/263; H01F 27/33; H01F 17/06; H01F 17/062; H01F 27/303
See application file for complete search history.

(56) References Cited

U.S. PATENT DOCUMENTS 4,837,543 A * 6/1989 Humen ..... H01F 27/02 336/92
5,331,304 A * 7/1994 White ..... H01F 27/25 336/219
(Continued)

FOREIGN PATENT DOCUMENTS

JP 2009-246222 A 10/2009
JP 2011-119664 A 6/2011
(Continued)

OTHER PUBLICATIONS

International Search Report, Application No. PCT/JP2018/017456, dated Jul. 31, 2018. ISA/Japan Patent Office.

*Primary Examiner* — Mang Tin Bik Lian
(74) *Attorney, Agent, or Firm* — Honigman LLP

(57) ABSTRACT

Provided is a reactor including a coil having a pair of winding portions; and a ring-shaped magnetic core, the magnetic core including: a pair of inner core portions arranged inside of the winding portions; and a pair of outer core portions respectively arranged outside of one end and outside of another end in an axial direction of the winding portions, the reactor including a non-magnetic reinforcing member that is arranged between the pair of winding portions and is coupled to the inner end surfaces of the pair of outer core portions. An axial rigidity of the reinforcing member is $2\times10^7$ N/m or more. Here, the axial rigidity is a
(Continued)

value obtained by multiplying the cross-sectional area of the reinforcing member perpendicular to the axial direction of the winding portions and the Young's modulus of the reinforcing member, and dividing the result by the length of the reinforcing member.

11 Claims, 4 Drawing Sheets

(51) Int. Cl.
*H01F 27/30* (2006.01)
*H01F 37/00* (2006.01)

(56) References Cited

U.S. PATENT DOCUMENTS 6,424,246 B1 * 7/2002 Kysely ..... H01F 27/266 336/92
2002/0017976 A1 * 2/2002 Okamoto ..... H01F 27/027 336/229
2010/0226410 A1 * 9/2010 Maeno ..... H01F 27/402 374/208
2012/0206232 A1 8/2012 Yamamoto et al.
2012/0280779 A1 * 11/2012 Shih ..... H01F 27/366 336/196
2013/0154782 A1 * 6/2013 Won ..... H01F 27/29 242/430
2015/0000113 A1 * 1/2015 Ono ..... H01F 41/02 29/602.1
2015/0078054 A1 * 3/2015 Myhre ..... H01F 27/24 336/65
2015/0279550 A1 * 10/2015 Kitami ..... H01F 27/24 336/205

FOREIGN PATENT DOCUMENTS

JP 2012-080068 A 4/2012
JP 2012-169466 A 9/2012
JP 2017-139310 A 8/2017

* cited by examiner

REACTOR

CROSS-REFERENCE TO RELATED APPLICATIONS

This application is the U.S. national stage of PCT/JP2018/017456 filed on May 1, 2018, which claims priority of Japanese Patent Application No. JP 2017-100955 filed on May 22, 2017, the contents of which are incorporated herein.

TECHNICAL FIELD

The present disclosure relates to a reactor.

BACKGROUND

A reactor is one of the components used in a circuit that boosts/lowers a voltage. For example, JP 2011-119664A and JP 2009-246222A disclose reactors including a coil and a magnetic core on which the coil is arranged.

It is desired that noise that occurs during driving of a reactor is reduced.

A reactor is driven by exciting a coil through the application of an electric current of a predetermined frequency to the coil. While being driven, the reactor may vibrate due to magnetostriction or electromagnetic attraction caused by the occurrence of a magnetic flux in a magnetic core, which may cause noise.

SUMMARY

In view of this, in the present disclosure, an object is to provide a reactor that can suppress noise that occurs during driving.

The inventors of the present disclosure focused on the relationship between the drive frequency of a reactor and the natural frequency of a magnetic core, and investigated the influence of the drive frequency on the vibration characteristics of the reactor. In cases of reactors used in power conversion devices to be mounted in hybrid automobiles, electric automobiles, and the like, the drive frequency of an electric current applied to coils is generally within a range of 5 kHz to 15 kHz and particularly a range of about 5 kHz to 10 kHz. If the natural frequency of the magnetic core is close to this drive frequency, resonance will occur and noise will thus increase. In particular, if the drive frequency is within an audible range (generally 20 Hz to 20 kHz), the problem of noise will manifest.

Based on the above-described finding, the inventors of the present disclosure achieved a reactor according to embodiments of the present disclosure under the recognition that it is important to increase the natural frequency of the magnetic core in order to avoid resonance between the natural frequency of the magnetic core and the drive frequency.

An aspect of the present disclosure relates to a reactor including a coil having a pair of winding portions; and a ring-shaped magnetic core, the magnetic core including: a pair of inner core portions that are arranged inside of the winding portions; and a pair of outer core portions that are respectively arranged outside of one end and outside of another end in an axial direction of the winding portions, the reactor including a non-magnetic reinforcing member that is arranged between the pair of winding portions and is coupled to the inner end surfaces of the pair of outer core portions.

An axial rigidity of the reinforcing member is $2\times10^7$ N/m or more.

Here, the axial rigidity is a value obtained by multiplying the cross-sectional area of the reinforcing member that is perpendicular to the axial direction of the winding portions and the Young's modulus of the reinforcing member, and dividing the result by the length of the reinforcing member.

DESCRIPTION OF EMBODIMENTS OF THE PRESENT DISCLOSURE

Figure 1:
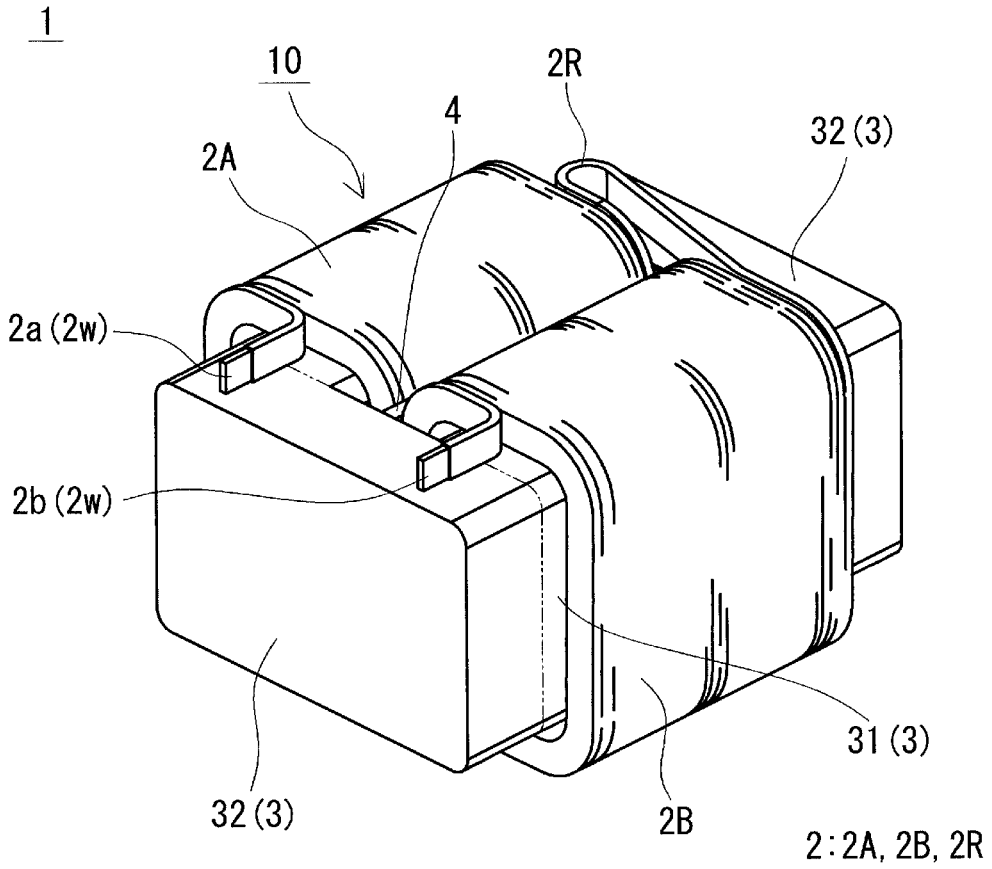
FIG. 1 is a schematic perspective view of a reactor according to an embodiment.

First, embodiments of the present disclosure will be listed and described.

A reactor according to an embodiment is a reactor including a coil having a pair of winding portions; and a ring-shaped magnetic core, the magnetic core including: a pair of inner core portions that are arranged inside of the winding portions; and a pair of outer core portions that are respectively arranged outside of one end and outside of another end in an axial direction of the winding portions, the reactor including a non-magnetic reinforcing member that is arranged between the pair of winding portions and is coupled to the inner end surfaces of the pair of outer core portions.

An axial rigidity of the reinforcing member is $2\times10^7$ N/m or more.

Here, the axial rigidity is a value obtained by multiplying the cross-sectional area of the reinforcing member that is perpendicular to the axial direction of the winding portions and the Young's modulus of the reinforcing member, and dividing the result by the length of the reinforcing member.

Here, the axial rigidity is a value obtained by multiplying the cross-sectional area of the reinforcing member perpendicular to the axial direction of the winding portions and the Young's modulus of the reinforcing member, and dividing the result by the length of the reinforcing member.

The above-described axial rigidity is as follows when expressed as an equation.

$$\text{Axial rigidity}=(\text{cross-sectional area of reinforcing member})\times(\text{Young's modulus of reinforcing member})\div(\text{length of reinforcing member})$$

As shown in the above-described configuration, the reinforcing member is coupled to the two inner end surfaces of the pair of outer core portions, and the axial rigidity of the reinforcing member is a predetermined value or more, whereby it is possible to make it difficult for the magnetic core to expand and contract in the axial direction of the winding portions. As a result, the natural frequency of the magnetic core of the reactor can be set to a height at which it is not likely to resonate with the drive frequency of the reactor (5 kHz to 15 kHz, and in particular, 5 kHz to 10 kHz). A reactor that includes a magnetic core that is not likely to resonate makes it possible to suppress noise that occurs during driving of the reactor.

Here, the natural frequency of the member is proportional to the square root of a value obtained by dividing the spring constant of the member by the mass. If the axial rigidity of the reinforcing member is low, the mass of the reinforcing member will have a greater influence on the natural frequency of the magnetic core, and the natural frequency of the magnetic core may shift to a lower frequency. For this reason, if the axial rigidity of the reinforcing member falls below $2\times10^7$ N/m, the significance of arranging the reinforcing member will decrease, and therefore it is preferable to set the axial rigidity to $2\times10^7$ N/m.

Due to the natural frequency of the magnetic core being higher than the drive frequency (e.g., 5 kHz to 10 kHz), noise caused by vibration can be suppressed. In particular, it is more preferable that the natural frequency of the magnetic core is at least 10% higher than the drive frequency. For example, when the drive frequency is 10 kHz, the natural frequency is 11 kHz or more. In this case, the natural frequency of the magnetic core is sufficiently higher than the drive frequency, thus making it possible to significantly suppress noise caused by vibration.

As one aspect of a reactor according to an embodiment, the Young's modulus of the reinforcing member is 15 GPa or more.

With the reactor of the present embodiment, the reinforcing member is arranged at a position between the pair of winding portions. For this reason, when a reinforcing member with a large cross-sectional area, that is, a wide reinforcing member, is arranged, the reactor increases in size. In contrast, by increasing the Young's modulus of the reinforcing member, the axial rigidity of the reinforcing member can be increased without increasing the cross-sectional area of the reinforcing member. In particular, by setting the Young's modulus of the reinforcing member to 20 GPa or more, even if the width of the reinforcing member is made small, it is easy to set the axial rigidity of the reinforcing member to $2\times10^7$ N/m or more, and the increase in the size of the reactor can be suppressed.

As one aspect of a reactor according to an embodiment, thermal conductivity of the reinforcing member is 5 W/m·K or more.

Heat is likely to be accumulated between the pair of winding portions, and if heat is accumulated in that portion, the magnetic characteristics of the reactor may change. In contrast, if the thermal conductivity of the reinforcing member arranged between the pair of winding portions is 5 W/m·K or more, heat is not likely to be accumulated in this portion, and the magnetic characteristics of the reactor can be stabilized.

As one aspect of a reactor according to an embodiment, the reinforcing member is made of metal.

Examples of the metal forming the reinforcing member include aluminum, alloys thereof, magnesium, and alloys thereof. These metals have high Young's moduli and are non-magnetic, and therefore are suitable as reinforcing members.

As one aspect of a reactor according to an embodiment, the reactor includes a molded resin portion in which the pair of winding portions are molded along with the reinforcing member.

The reinforcing member can be firmly fixed to the reactor by the molded resin portion, and therefore the natural frequency of the magnetic core can be further increased.

Hereinafter, specific examples of the reactor according to an embodiment of the present disclosure will be described with reference to the drawings. In the figures, components with the same name are denoted by the same reference numeral. The present disclosure is not limited to these embodiments and is defined by the scope of the appended claims, and all changes that fall within the same essential spirit as the scope of the claims are intended to be included therein.

Embodiment 1

Overall Configuration

A reactor 1 of Embodiment 1 will be described with reference to FIGS. 1 to 4. The reactor 1 of Embodiment 1 shown in FIGS. 1 and 2 includes: a coil 2 having a pair of winding portions 2A and 2B; and a ring-shaped magnetic core 3. One feature of the reactor 1 can be that a reinforcing member 4 arranged between the pair of winding portions 2A and 2B is included. Hereinafter, a configuration of a reactor according to Embodiment 1 will be described in detail.

Coil

The coil 2 includes: a pair of winding portions 2A and 2B formed by winding a winding wire 2*w*; and a coupling portion 2R that connects the two winding portions 2A and 2B. The winding portions 2A and 2B are formed into tube shapes by winding the winding wire 2*w* into a spiral shape, and the two winding portions 2A and 2B are arranged side by side (in parallel) such that their axial directions are parallel. In the present example, the numbers of windings and cross-sectional areas of the winding portions 2A and 2B are the same, and the cross-sectional areas of the winding wires 2*w* are the same, but the numbers of windings of the winding portions 2A and 2B and the cross-sectional areas of the winding wires 2*w* may also be different. Also, in the present example, the coil 2 is produced using one winding wire 2*w*, but the coil 2 may also be produced by coupling winding portions 2A and 2B that have been produced using separate winding wires 2*w*.

The winding portions 2A and 2B of the present embodiment are formed into rectangular tube shapes. The rectangular tube-shaped winding portions 2A and 2B are winding portions whose end surface shape is a quadrangular shape (includes a square shape) with rounded corners. Of course, the winding portions 2A and 2B may also be formed into circular tube shapes. Circular tube-shaped winding portions are winding portions whose end surface shapes are a closed curved surface shape (elliptical shape, circular shape, racetrack shape, etc.).

The coil 2 including the winding portions 2A and 2B can be formed using a covered wire that includes an insulating covering composed of an insulating material on the external circumference of a conductor such as a flat wire or a round wire composed of a conductive material such as copper, aluminum, magnesium, or an alloy thereof. In the present embodiment, the winding portions 2A and 2B are formed by winding, in an edgewise manner, a covered wire in which the conductor is composed of a flat wire (winding wire 2*w*) made of copper and the insulating covering is composed of enamel (typically polyimide-based resin).

The two end portions 2*a* and 2*b* of the coil 2 extend from the winding portions 2A and 2B and are connected to terminal members (not shown). An insulating covering such as enamel is peeled off at the two end portions 2*a* and 2*b*. An external apparatus such as a power source for performing power supply to the coil 2 is connected via these terminal members.

Magnetic Core

The configuration of the magnetic core 3 is not particularly limited, as long as it is a configuration according to which a ring-shaped closed magnetic path can be formed, and a known configuration can be used thereas. For convenience, the magnetic core 3 can be divided into a pair of inner core portions 31 and a pair of outer core portions 32.

Figure 2:
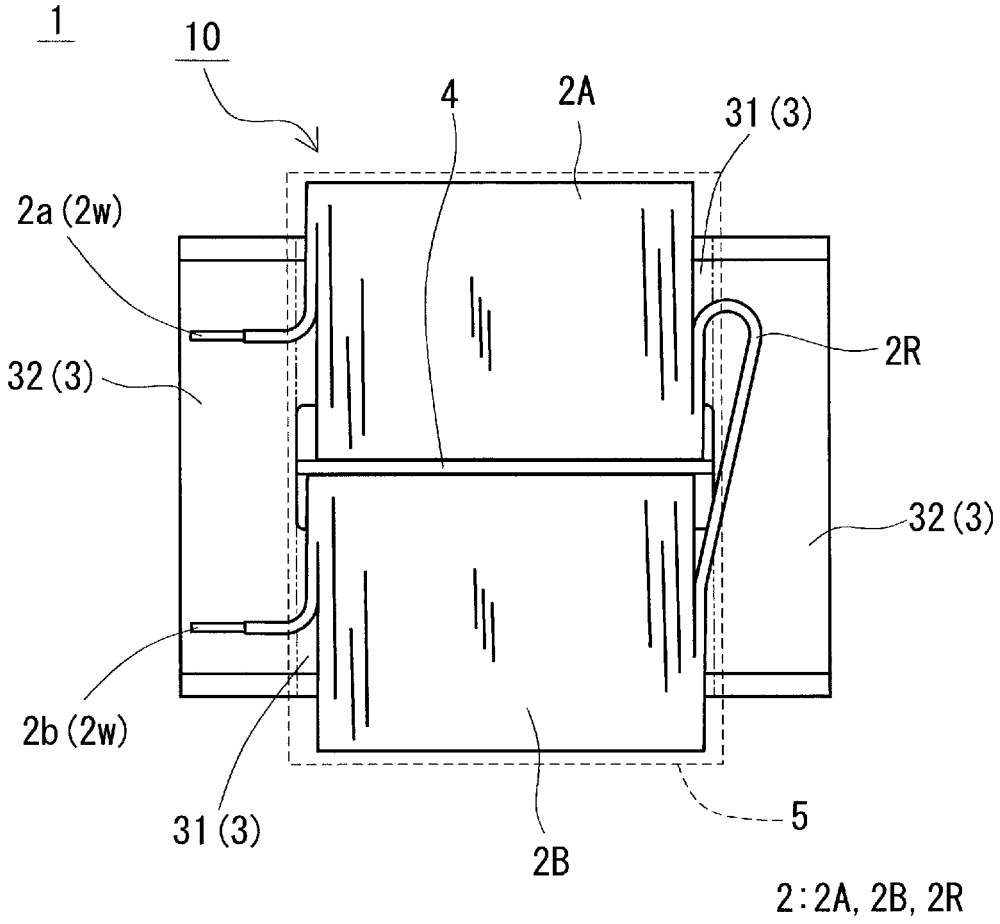
FIG. 2 is a schematic top view of a reactor according to an embodiment.

The inner core portions 31 are portions that are mainly arranged inside of the winding portions 2A and 2B of the coil 2. Here, the inner core portions 31 refer to portions of the magnetic core 3 that run along the axial direction of the winding portions 2A and 2B of the coil 2. For example, in the present example, the end portions in the axial direction of the inner core portions 31 protrude outward from the end surfaces of the winding portions 2A and 2B. The two-dot chain lines shown in FIGS. 1 and 2 are virtual borders between the inner core portions 31 and the outer core portions 32.

On the other hand, the outer core portions 32 are portions that are arranged outside of the winding portions 2A and 2B and have shapes that connect the end portions of the two inner core portions 31. The upper surfaces and the lower surfaces of the outer core portions 32 in this example are flatly connected to the upper surfaces and the lower surfaces of the inner core portions 31. Unlike the present example, the upper surfaces (lower surfaces) of the outer core portions 32 may also protrude upward (downward) with respect to the upper surfaces (lower surfaces) of the inner core portions 31.

Figure 3:
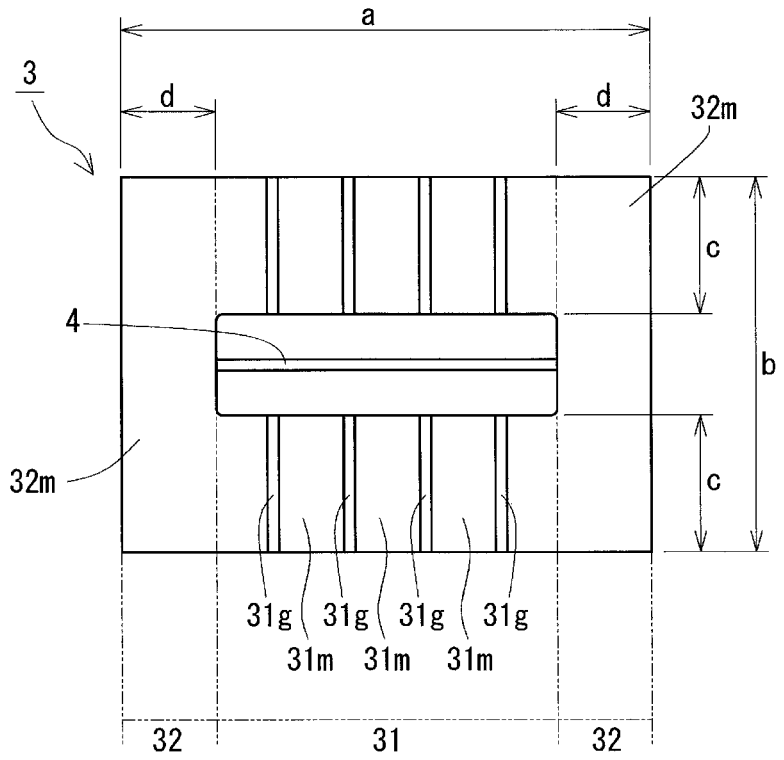
FIG. 3 is a top view of a magnetic core and a reinforcing member of a reactor according to an embodiment.
Figure 4:
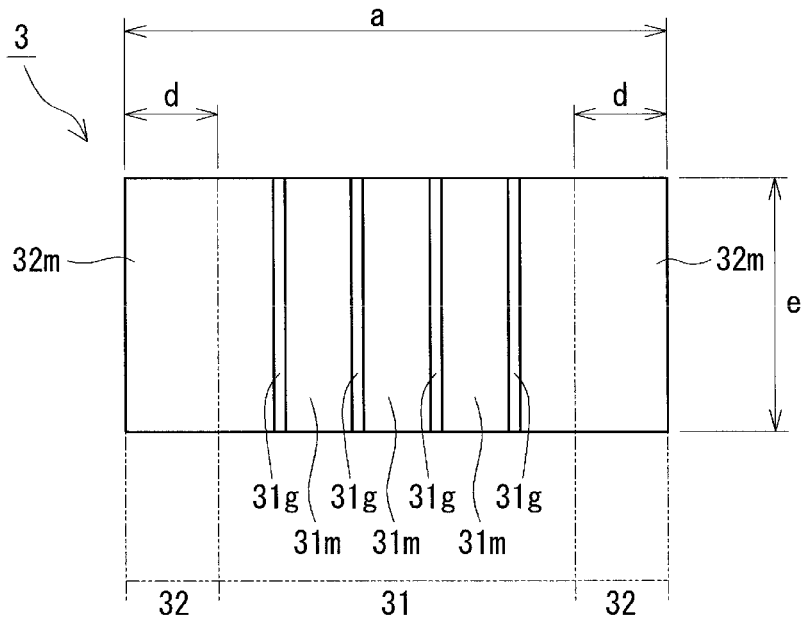
FIG. 4 is a side view of a magnetic core of a reactor according to an embodiment.

The magnetic core 3 can be formed by connecting multiple core pieces. The shape and the number of core pieces to be connected can be selected as appropriate. In the present example, as shown in FIGS. 3 and 4, the magnetic core 3 is formed by connecting two approximately U-shaped core pieces 32*m* and six cuboid core pieces 31*m* via gap materials 31*g*. In this example, one inner core portion 31 is formed by the protruding portions of the U shapes of the two core pieces 32*m*, three core pieces 31*m*, and four gap materials 31*g*. Also, one outer core portion 32 is formed by the base portion of the U shape of the core piece 32*m*.

The core pieces 31*m* and 32*m* may also be made of the same materials or different materials. Examples of the former case include a case in which all of the core pieces 31*m* and 32*m* are made of pressed powder molded bodies or a composite material. Examples of the latter case include a case in which the core pieces 31*m* are made of compressed powder molded bodies and the core pieces 32*m* are made of a composite material. A plate material composed of a non-magnetic material such as alumina can be used as the gap materials 31*g*. However, the gap materials 31*g* need not be included.

The composite material is a magnetic material including a soft magnetic powder and a resin. The soft magnetic powder is aggregates of magnetic particles that are constituted by an iron-group metal such as iron, an alloy thereof (Fe—Si alloy, Fe—Si—Al alloy, Fe—Ni alloy, etc.), or the like. Insulating coverings made of a phosphate or the like may also be formed on the outer surfaces of the magnetic particles. For example, a thermosetting resin such as epoxy resin, phenol resin, silicone resin, or urethane resin, a thermoplastic resin such as PPS resin, PA resin such as nylon 6 or nylon 66, polyimide resin, or fluororesin, or the like can be used as the resin. The composite material may also contain a filler and the like. Calcium carbonate, talc, silica, clay, various fibers such as alamide fibers, carbon fibers, and glass fibers, mica, glass flake, or the like can be used as the filler.

The content of the soft magnetic powder in the composite material may be 50 mass % or more and 80 mass % or less when the composite material is 100%. Due to the content of the magnetic powder being 50 mass % or more, the percentage of the magnetic component is sufficiently high, and therefore the saturation magnetic flux density is easily increased. When the content of the magnetic powder is 80 mass % or less, the mixture of the magnetic powder and the resin has a high fluidity, and thus it is possible to obtain a composite material with excellent moldability. The lower limit of the content of the magnetic powder may be 60 mass % or more. Also, the upper limit of the content of the magnetic powder may be 75 mass % or less and 70 mass % or less.

In contrast to the composite material, the pressed powder molded body is a magnetic body formed by press-molding a raw-material powder containing soft magnetic powder. Insulating coverings made of a phosphate or the like may also be formed on the outer surfaces of the magnetic particles. The raw-material powder may also contain a resin such as a binder, or may contain a filler or the like.

Reinforcing Member

The reinforcing member 4 is a member that is arranged between the two winding portions 2A and 2B, and is coupled using an adhesive agent or the like to the inner end surfaces (surfaces on the inner core portion 31 side) of the two outer core portions 32. In addition, the reinforcing member 4 and the outer core portions 32 may also be coupled through mechanical engagement, such as protrusions and recessions. Due to the reinforcing member 4 being arranged so as to connect the inner end surface of one outer core portion 32 of the ring-shaped magnetic core 3 and the inner end surface of the other outer core portion 32, the reinforcing member 4 supports the magnetic core 3 from the inner side of the ring, and suppresses expansion and contraction of the magnetic core 3 in the axial direction of the winding portions 2A and 2B. The natural frequency of the magnetic core 3 can be increased due to the expansion and contraction of the magnetic core 3 being suppressed by the reinforcing member 4. As a result, it is possible to suppress a case in which the magnetic core 3 resonates with the drive frequency of the reactor 1.

The reinforcing member 4 is a member that is prepared separately from the magnetic core 3. For this reason, when arranging the reinforcing member 4, it is preferable that the reinforcing member 4 is arranged between the winding portions 2A and 2B so as not to damage the insulating covering of the winding portions 2A and 2B. For example, the magnetic core 3 is attached to the winding portions 2A and 2B after the space between the winding portions 2A and 2B is widened and the reinforcing member 4 is interposed in the widened portion. If the adhesive agent is applied to the two end surfaces of the reinforcing member 4 interposed between the winding portions 2A and 2B, the reinforcing member 4 can be coupled to the inner end surfaces of the outer core portions 32 of the magnetic core 3. An adhesive agent that has high hardness and little elongation when cured is preferably used as the adhesive agent. For example, an epoxy-based adhesive agent, a ceramic-based adhesive agent, or the like can be used. By using this kind of adhesive agent, the reinforcing member 4 can effectively suppress expansion and contraction when the magnetic core 3 tends to expand or contract in the length direction of the winding portions 2A and 2B.

The reinforcing member 4 is constituted by a material that is non-magnetic and according to which the later-described axial rigidity of the reinforcing member 4 can be set to $2\times10^7$ N/m or more. For example, the reinforcing member 4 can be constituted by a non-magnetic metal such as aluminum, an alloy thereof, magnesium, or an alloy thereof. In addition, the reinforcing member 4 can also be constituted by ceramics, a resin with a high Young's modulus, a fiber-reinforced plastic, or the like.

The reinforcing member 4 has an axial rigidity of $2\times10^7$ N/m or more. The axial rigidity can be obtained by multiplying the cross-sectional area ($mm^2$) of the reinforcing member 4 perpendicular to the axial direction of the winding portions 2A and 2B and the Young's modulus (MPa) of the reinforcing member 4 and dividing the result by the length (mm) of the reinforcing member 4. The higher the axial rigidity of the reinforcing member 4 is, the higher the natural frequency of the magnetic core 3 tends to be, and the greater the amount that the natural frequency of the magnetic core 3 diverges from the drive frequency of the reactor 1 can be made. For example, it is preferable that the natural frequency of the magnetic core 3 diverges more than 1% from the drive frequency of the reactor 1, and it is more preferable that the natural frequency of the magnetic core 3 diverges more than 2.5% therefrom. If the divergence amount increases, it is possible to suppress a case in which the magnetic core 3 resonates with the drive frequency of the reactor 1. From these viewpoints, the axial rigidity of the reinforcing member 4 is preferably $4\times10^7$ N/m or more, and more preferably $4\times10^8$ N/m or more.

Since the reinforcing member 4 is arranged in a narrow gap between the two winding portions 2A and 2B, it is difficult to make the cross-sectional area of the reinforcing member 4 large. In order to make the cross-sectional area large, the height of the reinforcing member 4 (the length of the reinforcing member 4 in the height direction of the reactor 1, that is, the up-down direction in FIG. 1) needs to be made large, or the width of the reinforcing member 4 (the length of the reinforcing member 4 in the parallel direction of the winding portions 2A and 2B, that is, the up-down direction in FIG. 2) needs to be made large. Here, when the width of the reinforcing member 4 is made large, the distance between the winding portions 2A and 2B increases, and there is a possibility that an increase in the size of the reactor 1 will be incurred. In order to ensure a cross-sectional area of the reinforcing member 4 of a predetermined value or more while suppressing an increase in the size of the reactor 1, it is preferable to use a flat plate-shaped reinforcing member 4 with a small width and a high height.

The width of the reinforcing member 4 is preferably 1 mm or more and 5 mm or less. The upper limit of the width is more preferably 3 mm or less, and most preferably 2 mm or less. On the other hand, the height of the reinforcing member 4 need only be selected as appropriate according to the sizes of the winding portions 2A and 2B, and it is preferable to increase the size as much as possible in a range of not hindering the installation of the reactor 1. For example, when the winding portions 2A and 2B are viewed from the side, the height of the reinforcing member 4 may be maximized in a range in which the reinforcing member 4 does not protrude from the upper end surfaces and the lower end surfaces of the winding portions 2A and 2B.

As described above, it is difficult to increase the cross-sectional area of the reinforcing member 4, and therefore in order to increase the axial rigidity of the reinforcing member 4, it is preferable to form the reinforcing member 4 using a material with a high Young's modulus. The Young's modulus of the reinforcing member 4 is preferably 15 GPa or more, and more preferably 20 GPa or more. In particular, it is easy to set the axial rigidity of the reinforcing member 4 to $2\times10^7$ N/m or more by setting the Young's modulus of the reinforcing member 4 to 20 GPa or more. Examples of the material of the reinforcing member 4 having a Young's modulus of 20 GPa or more can include a metal such as aluminum described above. A metal such as aluminum has a thermal conductivity of 5 W/m·K or more and is preferable as the material of the reinforcing member 4 also from the viewpoint of improving the heat dissipating property of the reactor 1.

Here, the Young's modulus of a representative material of the reinforcing member 4 is indicated. For example, the Young's modulus of the aluminum or an alloy thereof is about 70 to 75 GPa, the Young's modulus of the magnesium alloy is about 45 GPa, and the Young's modulus of the alumina is about 400 GPa.

Effect

The reactor 1 including the reinforcing member 4 is a reactor 1 which has little noise caused by vibration. This is because the natural frequency of the magnetic core 3 is increased due to the reinforcing member 4 and diverges from the drive frequency of the reactor 1.

Application

The reactor 1 of Embodiment 1 can suitably be used in, for example, various converters such as a converter for an air conditioner, an in-vehicle converter (typically a DC-DC converter) to be mounted in a vehicle such as a hybrid automobile, a plug-in hybrid automobile, an electric automobile, or a fuel-cell automobile, or a constituent component of a power conversion apparatus.

Other Configurations

The reactor 1 of the embodiment may also include the following configurations.

An interposed member (not shown) that is interposed between the coil 2 and the magnetic core 3 may also be included. The interposed member is constituted by an electrically insulating material, and the electrical insulation between the coil 2 and the magnetic core 3 is ensured.

Examples of the interposed member include: an inner interposed member (not shown) that is interposed between the inner circumferential surfaces of the winding portions 2A and 2B and the outer circumferential surfaces of the inner core portions 31; and an outer interposed member (not shown) that is interposed between the end surfaces of the winding portions 2A and 2B and the inner end surfaces of the outer core portions 32. For example, a thermoplastic resin such as polyphenylene sulfide (PPS) resin, polytetrafluoroethylene resin, liquid crystal polymer, polyamide (PA) resin such as nylon 6 and nylon 66, and polybutylene terephthalate resin can be used as the forming material of these interposed members.

A case (not shown) for storing a combined body of the coil 2 and the magnetic core 3 may also be included. Accordingly, the combined body can be protected from the outside environment (dust, corrosion, etc.) and can be mechanically protected. As long as the case is made of metal, the entirety thereof can be used as a heat dissipating path, and therefore heat that occurs in the coil 2 and the magnetic core 3 can be efficiently dissipated to an external installation target, and the heat dissipating property improves.

Also, if the combined body is stored in the case, a sealing resin that seals the combined body in the case may also be included. Accordingly, it is possible to achieve electrical and mechanical protection of the combined body, protection from the outside environment, and the like. For example, epoxy resin, urethane resin, silicone resin, unsaturated polyester resin, PPS resin, or the like can be used as the sealing resin. From the viewpoint of increasing the heat dissipating property, a ceramic filler with a high thermal conductivity such as alumina or silica may also be mixed into the sealing resin.

A molded resin portion 5 (see the two-dot chain line in FIG. 2) in which the winding portions 2A and 2B are molded along with the reinforcing member 4 may also be included. By forming the molded resin portions 5, the reinforcing member 4 can be firmly fixed to the reactor 1, and thus the natural frequency of the magnetic core 3 can be even more increased. A configuration may also be used in which the molded resin portion 5 molds the magnetic core 3 along with the coil 2. In this case, the combined body of the coil and the magnetic core can be electrically and mechanically protected from the outside environment without using a case. For example, the molded resin portion may be made of epoxy resin, PPS resin, PA resin, or the like.

Experimental Example 1

Vibration characteristics of reactors 1 including the reinforcing members 4 described in the embodiment were evaluated through experiments. Specifically, the vibration characteristics of a magnetic core 3 (sample no. 100) that does not include the reinforcing member 4 and multiple magnetic cores 3 (samples no. 1 to 10) that include reinforcing members 4 with changed Young's moduli were compared. The vibration characteristics were evaluated through CAE (Computer Aided Engineering) analysis using structural analysis software, and the natural frequency of the magnetic core was determined. A mesh for the CAE analysis was made of a hexa (hexahedral) mesh. In Experimental Example 1, an eigenvalue analysis and a frequency response analysis were performed using MSC Nastran (manufactured by MSC Software Corporation) as the structural analysis software, and a natural frequency of a vibration mode with expansion and contraction in the X direction (longitudinal direction) was determined as the natural frequency of the magnetic core.

Settings of Magnetic Core

Dimensions (mm) of the portions of the magnetic core 3 were as follows (see FIGS. 3 and 4).

Length (a) of magnetic core 3: 82.5

Width (b) of magnetic core 3: 70.5

Width (c) of inner core portion 31: 22.5

Thickness (d) of outer core portion 32: 18.0

Height (e) of outer core portion 32: 42.0

The materials forming the magnetic core 3 and their characteristics were set as follows.

Core pieces 31*m*, 32*m*: the Young's modulus was set to 38500 MPa, the Poisson's ratio was set to 0.25, and the density was set to 7200 kg/m$^3$, as corresponding to the characteristics of pressed powder molded bodies.

Gap materials 31*g*: the Young's modulus was set to 320000 MPa, the Poisson's ratio was set to 0.23, and the density was set to 3700 kg/m$^3$, as corresponding to the characteristics of ceramics.

Settings of Reinforcing Member

The reinforcing member 4 was set as follows.

The dimensions of the reinforcing member 4 were fixed at a thickness of 2 mm, a height of 42 mm, a length of 46.5 mm (i.e., a-2*d* in FIG. 3). Also, the Young's modulus of the reinforcing member 4 was changed in a range of 5000 MPa (5 GPa) to 1000000 MPa (1000 GPa). Incidentally, the Young's modulus of the aluminum or the alloy thereof is about 70 to 75 GPa, the Young's modulus of the magnesium alloy is about 45 GPa, and the Young's modulus of the alumina is about 400 GPa. In addition, a diamond sintered body or the like can be used as a material with a Young's modulus of about 1000 GPa. The Poisson's ratio and the density of the reinforcing member 4 were fixed at 0.3 and 2700 kg/m$^3$ respectively.

The natural frequencies of a reference model (sample no. 100) that does not include a reinforcing member 4 and the models (samples no. 1 to 10) obtained by changing the Young's moduli of the reinforcing members 4 were obtained through CAE analysis under the conditions above. The results are shown in Table 1 and FIG. 5. Table 1 shows the physical characteristics such as the dimensions and Young's moduli of the reinforcing members 4, the analysis results, and the like. The divergence rates (%) in Table 1 are obtained by expressing the increase amounts of the natural frequencies of the samples as percentages of the natural frequency of the reference model. Also, the evaluation "C" shown in Table 1 indicates that the divergence rate is 1% or less and the effect of reducing noise is insufficient, the evaluation "B" indicates that the divergence rate is greater than 1% and 2.5% or less and an effect of reducing noise to a certain extent can be expected, and the evaluation "A" indicates that the divergence rate is greater than 2.5% and a sufficient effect of reducing noise can be expected. Also, the horizontal axis in FIG. 5 indicates the axial rigidity of the reinforcing member 4, and the vertical axis indicates the natural frequency (Hz). The horizontal axis of FIG. 5 is displayed logarithmically.

TABLE 1

| | Reinforcing member | | | | | | Analysis result | | |
|---|---|---|---|---|---|---|---|---|---|
| Sample No. | Height (mm) | Thickness (mm) | Length (mm) | Area (mm$^2$) | Young's modulus (MPa) | Axial rigidity (N/m) | Natural frequency (Hz) | Divergence amount (%) | Evaluation |
| 100 | 42 | | | | | | 11464 | | |
| 1 | 42 | 2 | 46.5 | 84 | 5000 | 9032258 | 11497 | 0.3 | C |
| 2 | 42 | 2 | 46.5 | 84 | 10000 | 18064516 | 11583 | 1.0 | C |
| 3 | 42 | 2 | 46.5 | 84 | 15000 | 27096774 | 11665 | 1.8 | B |
| 4 | 42 | 2 | 46.5 | 84 | 20000 | 36129032 | 11743 | 2.4 | B |
| 5 | 42 | 2 | 46.5 | 84 | 50000 | 90322581 | 12152 | 6.0 | A |
| 6 | 42 | 2 | 46.5 | 84 | 100000 | 180645161 | 12670 | 10.5 | A |
| 7 | 42 | 2 | 46.5 | 84 | 150000 | 270967742 | 13045 | 13.8 | A |
| 8 | 42 | 2 | 46.5 | 84 | 200000 | 361290323 | 13324 | 16.2 | A |
| 9 | 42 | 2 | 46.5 | 84 | 500000 | 903225806 | 14089 | 22.9 | A |
| 10 | 42 | 2 | 46.5 | 84 | 1000000 | 1806451613 | 14410 | 25.7 | A |

Figure 5:
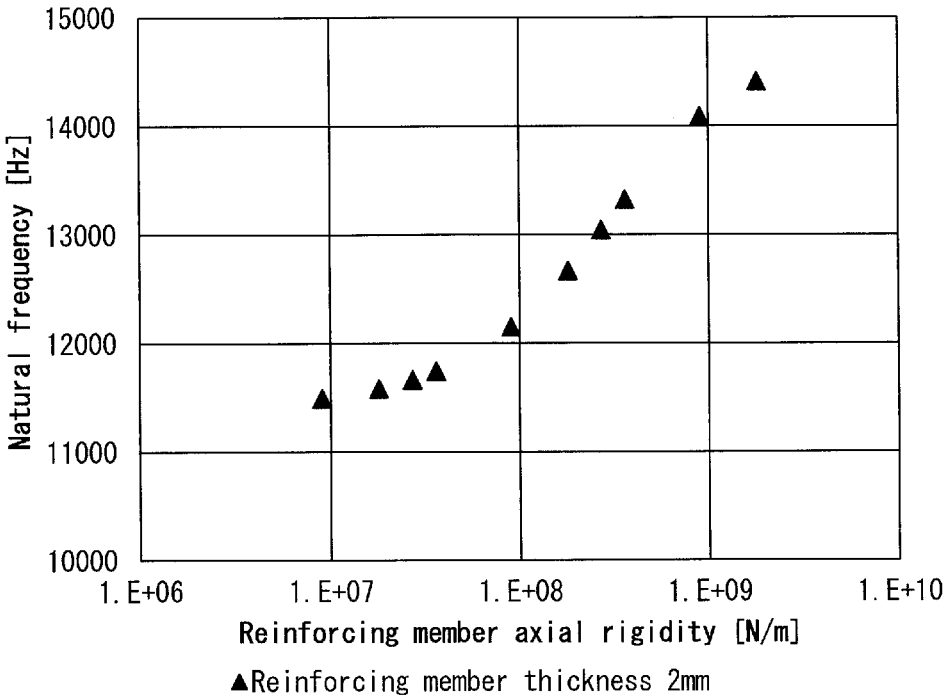
FIG. 5 is a graph showing the influence that the axial rigidity of a magnetic core has on a natural frequency of a magnetic core.

Based on the results shown in Table 1 and FIG. 5, it was understood that the natural frequency of the magnetic core 3 can be increased by increasing the Young's modulus of the reinforcing member 4, that is, increasing the axial rigidity of the reinforcing member 4. In particular, it was clear that in sample no. 3, in which the Young's modulus of the reinforcing member 4 was 15 GPa and the axial rigidity was $2.7\times10^7$ N/m or more ($2\times10^7$ N/m or more), the natural frequency of the magnetic core 3 becomes 1.8% (more than 1%) higher compared to the reference model, and a certain effect of reducing noise can be expected. In particular, it was clear that in sample no. 5, in which the axial rigidity of the reinforcing member 4 was $9\times10^7$ N/m or more ($4\times10^7$ N/m or more), the natural frequency of the magnetic core 3 becomes 6% (more than 2.5%) higher compared to the reference model, and a sufficient effect of reducing noise can be expected. Furthermore, in sample no. 9, in which the axial rigidity of the reinforcing member 4 is $9\times10^8$ N/m or more ($4\times10^8$ N/m or more), the natural frequency of the magnetic core 3 became 22% or more greater compared to the reference model.

The invention claimed is:

1. A reactor including a coil having a pair of winding portions; and a ring-shaped magnetic core, the magnetic core including: a pair of inner core portions that are arranged inside of the winding portions; and a pair of outer core portions that are respectively arranged outside of one end and outside of another end in an axial direction of the winding portions, the reactor comprising:

a non-magnetic reinforcing member that is arranged between the pair of winding portions and is adhered to the inner end surfaces of the pair of outer core portions by an adhesive agent, wherein the adhesive agent is an epoxy-based adhesive agent or a ceramic-based adhesive agent, wherein a width of the reinforcing member is between 1 mm and 5 mm, wherein an axial rigidity of the reinforcing member is $2\times10^7$ N/m or more, the axial rigidity being a value obtained by multiplying a cross-sectional area of the reinforcing member that is perpendicular to an axial direction of the winding portions and a Young's modulus of the reinforcing member, and dividing the result by a length of the reinforcing member.

2. The reactor according to claim 1, wherein the Young's modulus of the reinforcing member is 15 GPa or more.

3. The reactor according to claim 1, wherein thermal conductivity of the reinforcing member is 5 W/m·K or more.

4. The reactor according to claim 1, wherein the reinforcing member is made of metal.

5. The reactor according to claim 1, comprising a molded resin portion in which the pair of winding portions are molded along with the reinforcing member.

6. The reactor according to claim 2, wherein thermal conductivity of the reinforcing member is 5 W/m·K or more.

7. The reactor according to claim 2, wherein the reinforcing member is made of metal.

8. The reactor according to claim 3, wherein the reinforcing member is made of metal.

9. The reactor according to claim 2, comprising a molded resin portion in which the pair of winding portions are molded along with the reinforcing member.

10. The reactor according to claim 3, comprising a molded resin portion in which the pair of winding portions are molded along with the reinforcing member.

11. The reactor according to claim 4, comprising a molded resin portion in which the pair of winding portions are molded along with the reinforcing member.

* * * * *